US006616240B1

(12) United States Patent
Theosabrata et al.

(10) Patent No.: US 6,616,240 B1
(45) Date of Patent: Sep. 9, 2003

(54) HUMAN BODY SUPPORT STRUCTURE

(76) Inventors: Yos Soetanto Theosabrata, JL. Kav. Polri Blck D141205, Jakarta (ID), 11460; Leonard Theosabrata, 16967 Encino Hills Dr., Encino, CA (US) 91436

( * ) Notice: Subject to any disclaimer, the term of this patent is extended or adjusted under 35 U.S.C. 154(b) by 0 days.

(21) Appl. No.: 10/124,833

(22) Filed: Apr. 18, 2002

(51) Int. Cl.[7] ..... A47C 7/02
(52) U.S. Cl. ..... 297/452.64
(58) Field of Search ..... 297/452.64, 452.63

(56) References Cited

U.S. PATENT DOCUMENTS 3,226,285 A * 12/1965 Iovenko
4,367,897 A * 1/1983 Cousins
5,335,975 A * 8/1994 Krouskop et al.
5,398,993 A * 3/1995 Chen
6,334,650 B1 * 1/2002 Chien-Chuan

* cited by examiner

*Primary Examiner*—Milton Nelson, Jr.
(74) *Attorney, Agent, or Firm*—Jack C. Munro

(57) ABSTRACT

A human body support structure which provides a crossed series of cords mounted within an enclosed space formed by a rigid frame. Mounted on each of the cords are pins with a longitudinal axis of the pins being oriented perpendicular to the cords. Located between directly adjacent pins is a spacer with each spacer being mounted on a cord. The cords are slightly stretchable assuming a taut relationship when mounted relative to the frame. A human body is to be placed against and supported on the upper surface of the pins.

11 Claims, 3 Drawing Sheets

HUMAN BODY SUPPORT STRUCTURE

BACKGROUND OF THE INVENTION

1. Field of the Invention

The field of this invention relates generally to human body seating and reclining structures and more particularly to a support structure that is to be included within such a seating and reclining device.

2. Description of the Related Art

Human seating and reclining structures have long been known. Commonly, chairs, sofas and recliners have a flat surface with a cushion that may be placed on the flat surface. It has also been known to construct surfaces out of web strips which are crossed with these web strips being supported by a rigid frame. On the web strips, there will generally be located a cushion.

A common disadvantage of any chair or recliner that has a solid surface is that it lacks air circulation. In hot and humid environments or on any day in which the temperature is elevated, the chair or recliner will cause the user to sweat because there is no air circulation. Also, a solid surface chair or recliner does not follow the contour of the body rather the contour of the human body must conform to the configuration of the chair or recliner. Inherently, this is uncomfortable. It would be far more comfortable if the chair, sofa or recliner deflected to conform to the shape of the body.

SUMMARY OF THE INVENTION

The primary objective of the present invention is to construct a human body support structure that is to be used as a conventional chair, sofa or recliner. The human body support structure of the present invention provides for air circulation and also provides to comfortably support the body of the human by deflecting so the supporting surface conforms to the body of the human. Also, another feature of the present invention is that the human body support structure applies accupressure to the body of the human while the human is sitting or reclining within the chair, sofa or recliner.

A first main embodiment of the present invention utilizes a rigid frame that defines an enclosed space. A plurality of first cords is attached to the frame in a taut manner with these cords extending across the enclosed space. The first cords are located substantially parallel to each other. A plurality of pins are mounted on each first cord with each of the pins being elongated and having a longitudinal center axis. Each first cord passes transversely to its respective pin with the pins being oriented in a spaced-apart arrangement on each of the cords. A plurality of second cords is attached to the frame again in a taut manner. These second cords are also conducted through the pins with the second cords also being parallel to each other. The second cords are oriented substantially perpendicular to the first cords. A plurality of spacers are mounted on both the first cords and the second cords with each spacer being located on only a first cord or a second cord. Each spacer is located between a directly adjacent pair of pins with the spacers functioning to keep the spaced distance between the pins substantially constant. The human body is to be positioned against and supported by the pins with the pins deflecting from their originally established position due to the weight of the human body with the cords permitting this deflection. The longitudinal center axis of each of the pins is located substantially perpendicular to the human body.

A further embodiment of the present invention is where the first main embodiment is modified by the cords being stretchable.

A further embodiment of the present invention is where the first main embodiment is modified by the spacers being defined as being sleeves with either a first cord or a second cord passing through each of the sleeves.

A further embodiment of the present invention is where the first main embodiment is modified by the upper surface of each of the pins being rounded.

A further embodiment of the present invention is where the first main embodiment is modified by there being included a third set of cords which are located parallel to but spaced from the first cords.

A further embodiment of the present invention is where the first main embodiment is modified by there being a series of fourth cords which are also mounted on the pins with the fourth cords being located parallel to the second cords but spaced therefrom.

A second main embodiment of the present invention defines a human body support structure which comprises a rigid frame which defines an enclosed space. Mounted within the enclosed space and mounted on the frame is a crossed series of cords having thereon mounted a plurality of pins which are oriented in a parallel relationship. The upper surface of the pins provides a supporting surface for the body of the human.

A further embodiment of the present invention is where the second main embodiment is modified by the cords being stretchable.

A further embodiment of the present invention is where the second main embodiment is modified by there being spacers mounted on each cord with there being a separate spacer located between each directly adjacent pair of pins.

A further embodiment of the present invention is where the second main embodiment is modified by the upper end of the pins being rounded which is the surface of the pins that comes in direct contact with the body of the human user.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
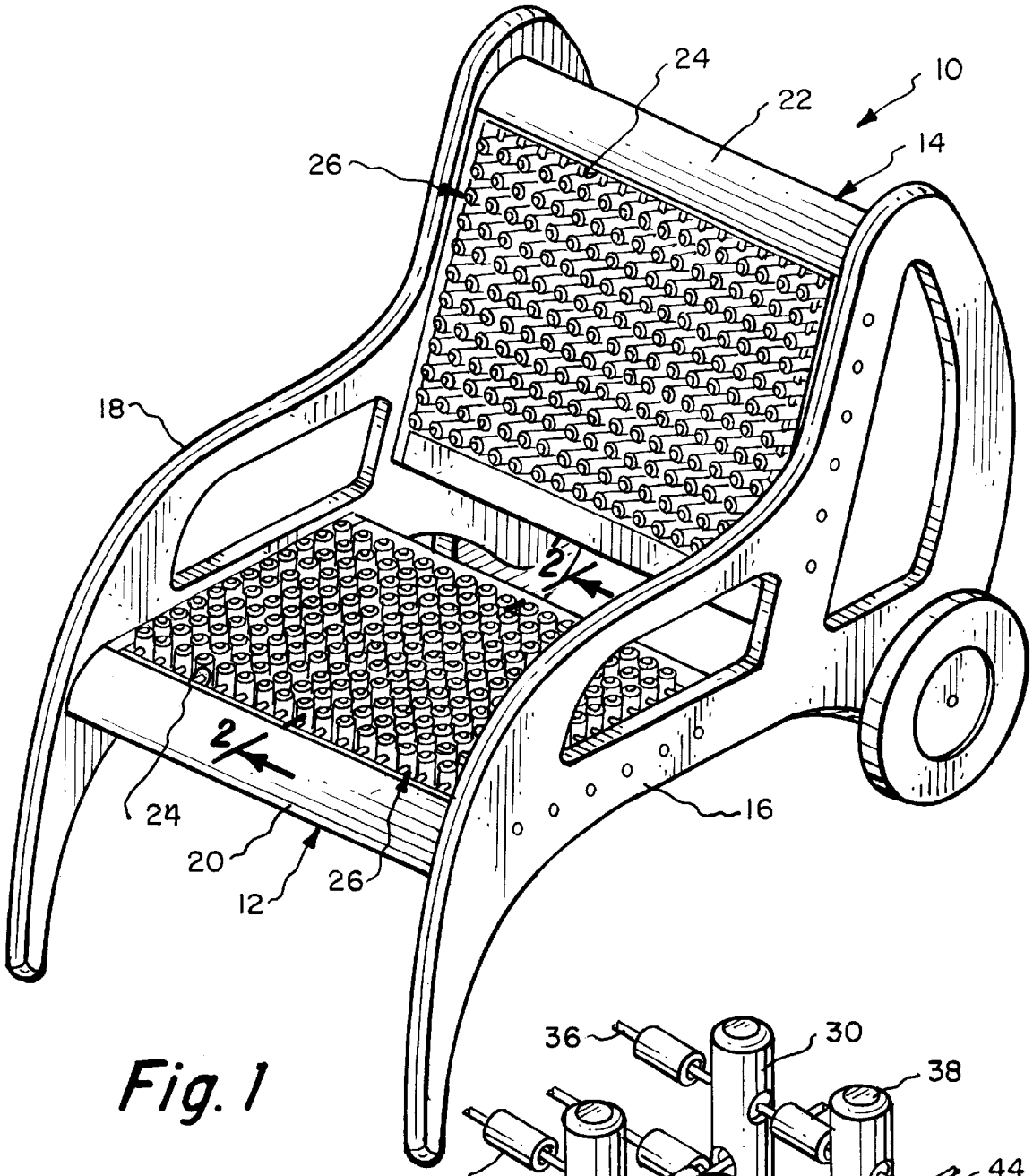
FIG. 1 is an isometric view of a chair within which has been incorporated the human body support structure of the present invention.
Figure 4:
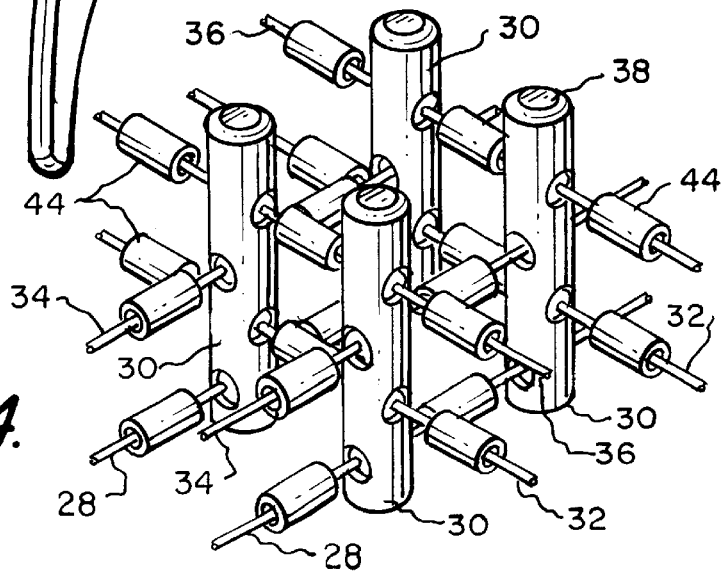
FIG. 4 is an exploded view of a portion of the human body support structure showing in more detail the elements that make up the structure.

Referring particularly to the drawings, there is shown in FIG. 1 a chair 10. The chair 10 has a seat 12 and a back 14. A left side 16 and a right side 18 are located on opposite sides of the seat 12 and the back 14 and connect together seat frame 20 and back frame 22. It can be seen by observing FIG. 1 that the back 14 is located substantially perpendicular to the seat 12. Although a chair 10 is shown in FIG. 1, it is to be understood that the subject matter of this invention could be incorporated in other types of human support structures, such as recliners, ottomans, sofas, chaise lounges, hammocks and any other type of structure that is designed for seating or reclining of a human. Typically, the structure of the present invention will be particularly useful in the construction of outdoor furniture, home furniture and office furniture. The seat frame 20 constitutes a rigid structure surrounding an enclosed space 24. A similar enclosed space 24 is formed by the back frame 22. Included within each enclosed space 24 is the human body support structure 26 of this invention.

Mounted between the members of the seat frame 20 or the back frame 22 are a series of first cords 28. The first cords 28 are to be slightly stretchable, small in diameter, maybe no more than an eighth of an inch in diameter, and resemble a string. Each of the cords 28 is mounted in a taut relationship on their respective seat frame 20 or back frame 22. Each of the first cords 28 are located evenly spaced apart. The number of the first cords 28 can be increased or decreased according to what is desired. It happens to be that the number selected is twelve in number. Each first cord 28 passes through a hole formed in a pin 30. There are actually twelve in number of the pins 30 mounted on the each first cord 28, and since there are eighteen in number of the first cords 28 located between the sides 16 and 18, that means there will be a total number of two-hundred and sixteen pins 30. There will be two-hundred and sixteen of the pins 30 located in both the seat 12 and the back 14. However, in a recliner, sofa, hammock or chaise lounge, it is understood that there will almost assuredly be a greater number of pins 30.

Between the sides 16 and 18, there are mounted a plurality of second cords 32. The second cords 32 are all identical and again the same as the first cords 28. The second cords 32 are located in a perpendicularly oriented relationship relative to the first cords 28. The second cords 32 also pass through a series of the pins 30 with it being understood that each cord 32 will pass through eighteen in number of the pins 30 while each cord 28 only passes through twelve in number of the pins 30 within the embodiment of the invention shown in FIG. 1.

There are also eighteen in number of third cords 34. The third cords 34 are located parallel to the first cords 28. Each third cord 34 is spaced about one and one-quarter inch from the first cord 28. Each third cord 34 also passes through a hole in each of the pins 30 with it being understood that each third cord 34 will be conducted through twelve in number of the pins 30.

Also mounted through a hole in each of the pins 30 is a fourth cord 36 with the fourth cords 36 also being identical in construction to the first cords 28. The fourth cords 36 are located parallel to each other and are located parallel to the second cords 32 and are spaced about one and one-quarter inch from each second cord 32. Each of the fourth cords 36 will also be conducted through eighteen in number of the pins 30.

Figure 2:
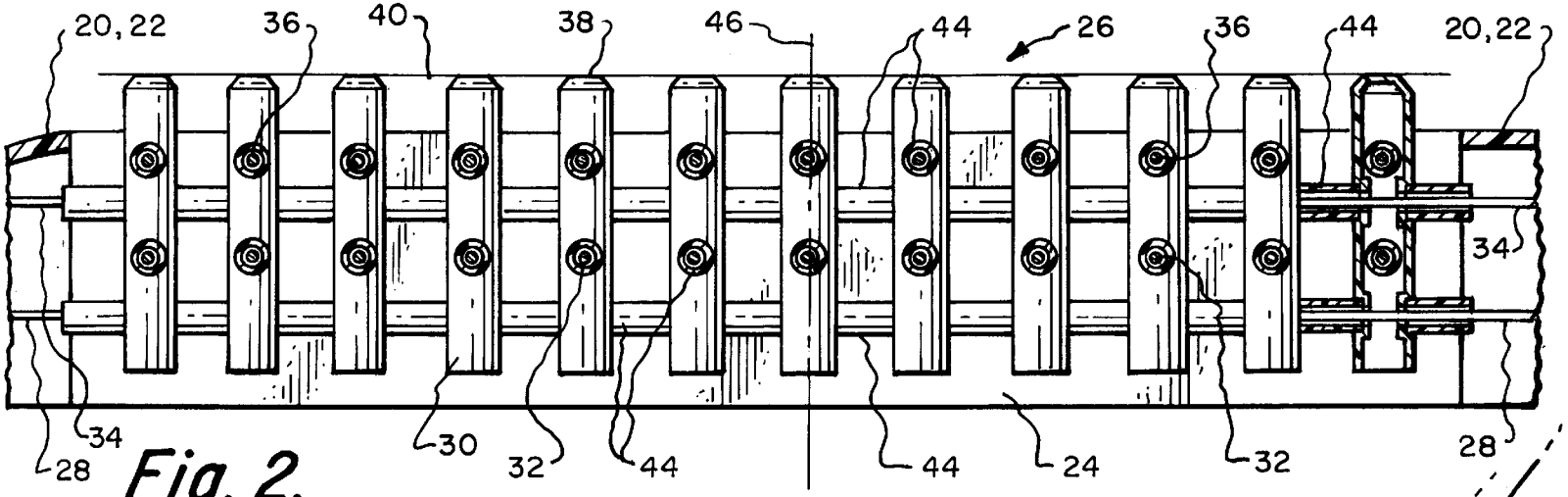
FIG. 2 is a longitudinal cross-sectional view through the human body support structure of the present invention taken along line 2—2 of FIG. 1 showing the support structure in its at-rest position when it is not in contact with a body of a human.
Figure 3:
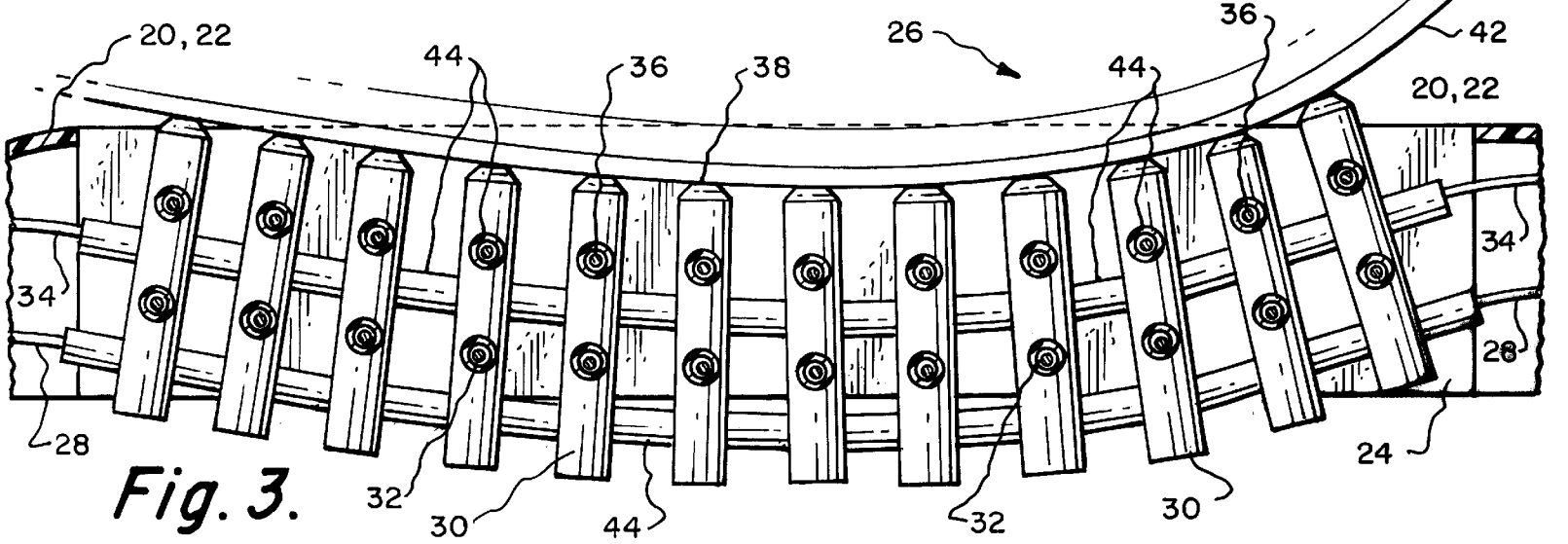
FIG. 3 is a view similar to FIG. 2 but showing the human body support structure in the position when it is in contact with the body of a human.

Each of the pins 30 has a rounded upper end 38. When there is no human resting against the structure 26, the pins 30 are in the position shown in FIG. 2 with the rounded upper end 38 all being located on a plane 40. However, when the human places his or her body against the rounded upper ends 38, the entire series of pins 30 will deflect, as shown in FIG. 3, with the human body being defined as line 42. The deflection of the pins 30 will be permitted by the stretching of the cords 28, 32, 34 and 36. The spacing between the pins 30 is maintained essentially constant by the using of spacers 44. Each spacer 44 constitutes a sleeve with each of the cords 28, 32, 34 and 36 being conducted through a series of the spacers 44 with there being a spacer 44 between each directly adjacent pair of pins 30. The function of the spacers 44 is to keep the pins 30 spaced about three-eighths of an inch to one-half of an inch apart. The spacers 44 are shown to be a separate part from the pins 30. However, it is considered to be within the scope of this invention that the spacers 44 could actually be incorporated to be part of the pins 30.

It is to be understood that when the weight of the human body is placed against the rounded upper ends 38 of the pins 30, as is shown in FIG. 3, the pins 30 do not deflect. Each pin 30 remains the same size. The pins 30 deflect within the structure 26 which is permitted by the stretchiness of the cords 28, 32, 34, and 36.

It is to be noted that when the weight of the human body is placed against the rounded upper ends 38, as is shown in FIG. 3, the pins 30 will actually pivot so that the longitudinal center axis 46 of each pin 30 will be located substantially perpendicular to the body surface represented by line 42. This perpendicular arrangement is desired as this is most comfortable to the user. Also, it is therapeutic in that the pins 30 function to apply accupressure to the user which may help to relieve soreness in muscles.

Because each pin 30 is supported on four different cords, 28, 32, 34 and 36, each of the pins 30 will function to twist as weight is applied to the plane 40 so as to maintain a perpendicular relationship with respect to the surface 42. Without the use of the four different cords, this twisting of each of the pins 30 would be difficult to accomplish. The length of each of the spacers 44 is deemed to be a matter of choice. However, in most instances the spacers 44 will be between one-fourth and one-half inch in length.

Figure 5:
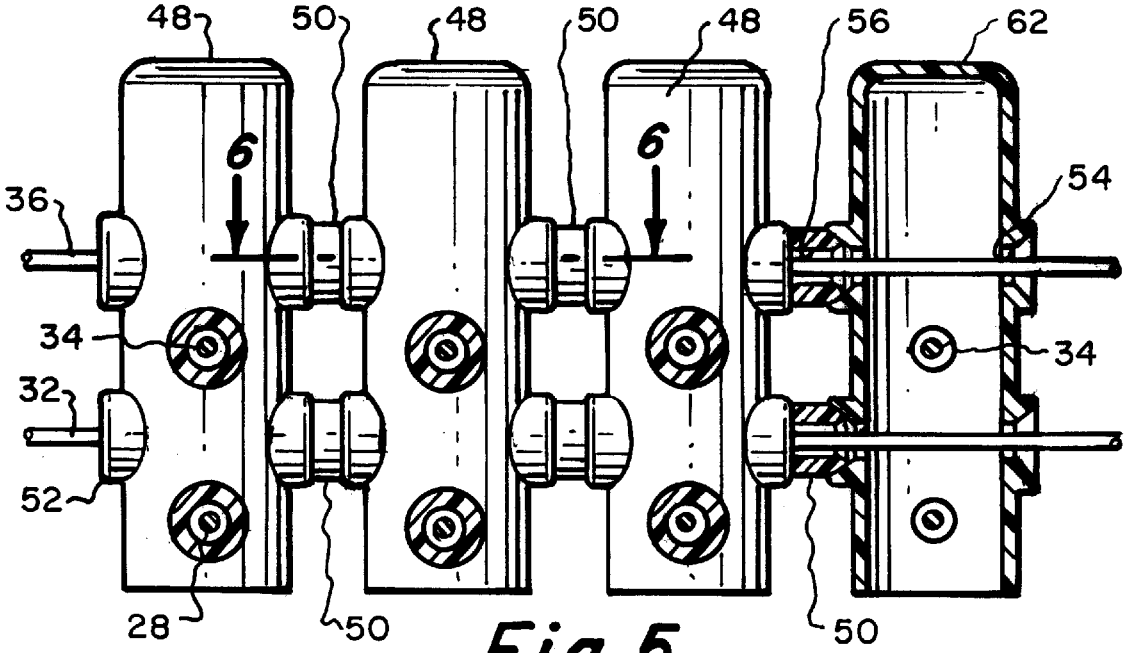
FIG. 5 is a side elevational view showing a modified form of pin and spacer arrangement.
Figure 6:
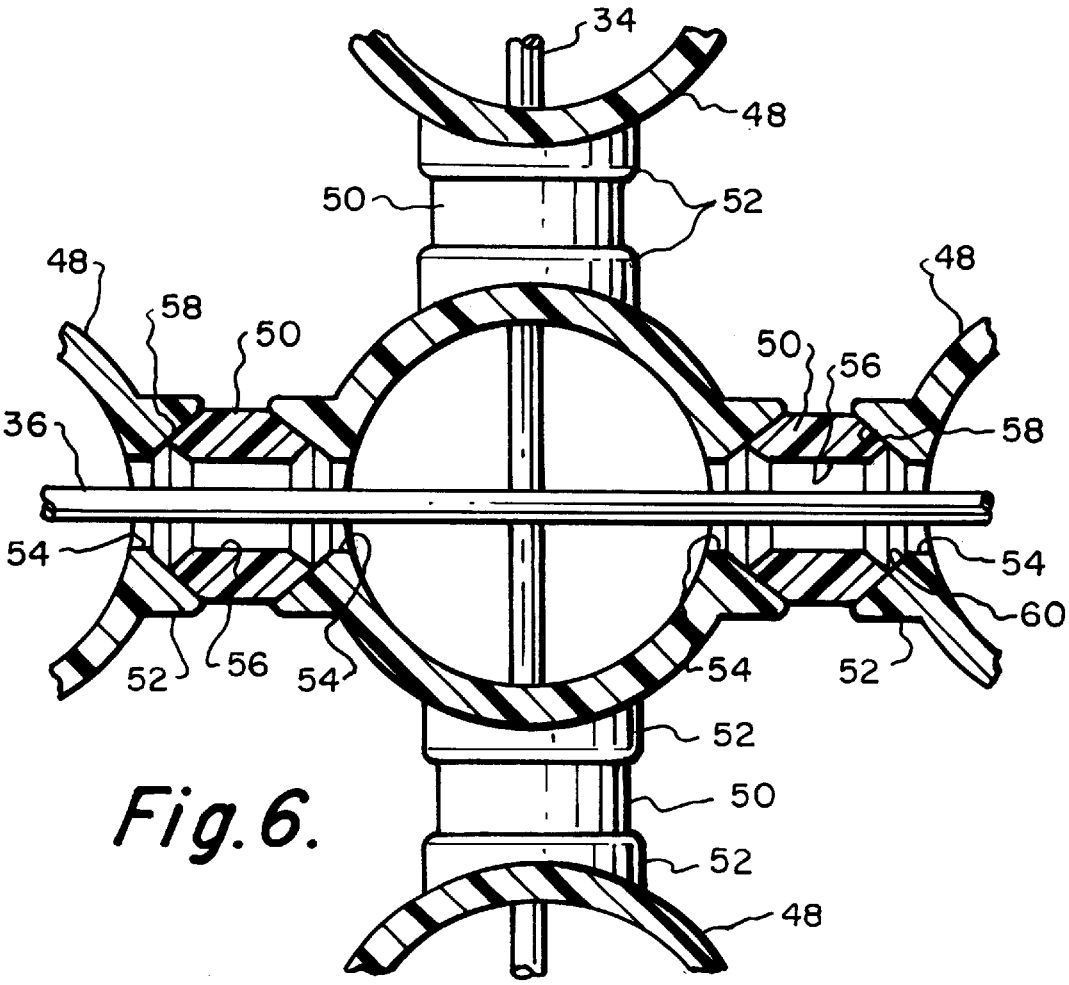
FIG. 6 is a cross-sectional view taken along line 6—6 of FIG. 5.

Referring particularly to FIGS. 5 and 6, there is shown a modified form of constructional arrangement between the pins 48 and the spacers 50. Each pin 48 has a plurality of bosses 52 which protrude from the sidewall of its respective pin 48. Each boss 52 is located at a hole 54 that is formed within the pin 48. It is to be understood that each pin 48 will have eight in number of the bosses 52. Each spacer 50 has a through hole 56. At the end of each spacer 50 forms an annular chamfered edge 58. Each chamfered edge 58 is to matingly engage with an annular inclined surface 60 formed interiorly of each boss 52. The structural arrangement between the pins and spacers in FIGS. 5–6 versus FIGS. 1–4 is that the pins 48 and spacers 50 are interconnected by the chamfered edges 58 and their respective annular inclined surfaces 60, wherein FIGS. 1–4 there is no such connection but just an abutting relationship. In FIGS. 5–6, there still is used the first cords 28, second cords 32, third cords 34 and fourth cords 36 in the same arrangement as was previously discussed in FIGS. 1–4.

Each of the pins 48 has a smoothly contoured tip 62 which is a little bit more flat than in FIGS. 1–4. The tips 62 provide a slightly greater flat surface area of contact than the rounded upper ends 38 which may prove to be more comfortable to a user.

What is claimed is:

1. A human body support structure comprising:

a rigid frame defining an enclosed space;

a plurality of first cords attached to said frame, said first cords being spaced apart and extending across said enclosed space in a taut manner, said first cords being substantially parallel;

a plurality of pins mounted on each said first cord, each of said pins being elongated and having a longitudinal center axis with each said first cord passing transversely through its respective said pin perpendicular to said longitudinal center axis with said pins being oriented in a spaced apart arrangement on each of said first cords;

a plurality of second cords attached to said frame, said second cords being spaced apart and extending across said enclosed space in a taut manner, said second cords being substantially parallel, each of said second cords passing transversely through a plurality of said pins perpendicular to said longitudinal center axis with said second cords being spaced apart, said second cords being oriented substantially perpendicular to said first cords;

a plurality of spacers mounted on both said first cords and said second cords with each said spacer being located on only a said first cord or a said second cord, each said spacer being located between a directly adjacent pair of said pins, said spacers functioning to keep the spaced distance between said pins substantially constant; and whereby a human body is to be positioned against and supported by said pins with said pins deflecting according to the contour of the human body and said longitudinal center axis of each said pin being located substantially perpendicular to the human body.

2. The human body support structure as defined in claim 1 wherein:

each said first cord being stretchable, each said second cord being stretchable.

3. The human body support structure as defined in claim 1 wherein:

each of said spacers comprising a sleeve with either a said first cord passing through a said sleeve or a said second cord passing through a said sleeve.

4. The human body support structure as defined in claim 1 wherein:

each of said pins having an upper end, said upper end being rounded, whereby said upper end of each said pin being adapted to come into contact with the human body and because each said upper end is rounded, a non-sharp and comfortable contactual arrangement is established with the human body.

5. A human body support structure comprising:

a rigid frame defining an enclosed space;

a plurality of first cords attached to said frame, said first cords being spaced apart and extending across said enclosed space in a taut manner, said first cords being substantially parallel;

a plurality of pins mounted on each said first cord, each of said pins being elongated and having a longitudinal center axis with each said first cord passing transversely through its respective said pin with said pins being oriented in a spaced apart arrangement on each of said first cords;

a plurality of second cords attached to said frame, said second cords being spaced apart and extending across said enclosed space in a taut manner, said second cords being substantially parallel, each of said second cords passing through a plurality of said pins with said second cords being spaced apart, said second cords being oriented substantially perpendicular to said first cords;

a plurality of spacers mounted on both said first cords and said second cords with each said spacer being located on only a said first cord or a said second cord, each said spacer being located between a directly adjacent pair of said pins, said spacers functioning to keep the spaced distance between said pins substantially constant;

whereby a human body is to be positioned against and supported by said pins with said pins deflecting according to the contour of the human body and said longitudinal center axis of each said sin being located substantially perpendicular to the human body; and a plurality of third cords attached to said frame, said third cords being spaced apart and extending across said enclosed space in a taut manner, said third cords being substantially parallel and also being parallel to said first cords, each said third cord passing through a plurality of said pins, each said third cord being spaced from the said first cord which has passed through a said pin.

6. The human body support structure as defined in claim 5 wherein:

there being a plurality of fourth cords attached to said frame, said fourth cords being spaced apart and extending across said enclosed space in a taut manner, said fourth cords being substantially parallel and being essentially identical in construction to said second cords, said fourth cords being located parallel to said second cords, each said fourth cord passing through a said pin and being spaced from said first cord, said second cord and said third cord.

7. The human body support structure as defined in claim 6 wherein:

the distance between a said second cord and a fourth cord relative to each said pin is approximately one and one-quarter inch.

8. The human body support structure as defined in claim 5 wherein:

the distance between a said first cord and a said third cord relative to a said pin is approximately one and one-quarter inch.

9. A human body support structure comprising:

a rigid frame defining an enclosed space;

a plurality of first cords attached to said frame, said first cords being spaced apart and extending across said enclosed space in a taut manner, said first cords being substantially parallel;

a plurality of pins mounted on each said first cord, each of said pins being elongated and having a longitudinal center axis with each said first cord passing transversely through its respective said pin with said pins being oriented in a spaced apart arrangement on each of said first cords;

a plurality of second cords attached to said frame, said second cords being spaced apart and extending across said enclosed space in a taut manner, said second cords being substantially parallel, each of said second cords passing through a plurality of said pins with said second cords being spaced apart, said second cords being oriented substantially perpendicular to said first cords;

a plurality of spacers mounted on both said first cords and said second cords with each said spacer being located on only a said first cord or a said second cord, each said spacer being located between a directly adjacent pair of said pins, said spacers functioning to keep the spaced distance between said pins substantially constant;

whereby a human body is to be positioned against and supported by said pins with said pins deflecting according to the contour of the human body and said longitudinal center axis of each said pin being located substantially perpendicular to the human body; and there being an interlocking arrangement between each said pin and its connected said spacers.

10. A human body support structure comprising:

a rigid frame defining an enclosed space, a crossed series of cords conducted across said enclosed space and having mounted thereon a plurality of pins with said pins being oriented substantially parallel;

whereby a human body is to be positioned against and supported by said pins with said pins deflecting to accommodate to the contour of the human body and maintain a substantially perpendicular position relative to the human body; and each of said pins having an upper end which is to come into direct contact with the human body, said upper end being at a longitudinal end of each said pin, each said upper end being smoothly contoured so as to provide a non-sharp comfortable surface in contact with the human body.

11. A human body support structure comprising:

a rigid frame defining an enclosed space, a crossed series of cords conducted across said enclosed space and having mounted thereon a plurality of pins with said pins being oriented substantially parallel;

whereby a human body is to be positioned against and supported by said pins with said sins deflecting to accommodate to the contour of the human body and maintain a substantially perpendicular position relative to the human body; and there being an interlocking arrangement between each said pin and its connected said spacers.

* * * * *